United States Patent [19]

Cooke, Sr. et al.

[11] 3,976,347

[45] Aug. 24, 1976

[54] ELECTRICAL CONNECTOR AND METHOD

[76] Inventors: Milton M. Cooke, Sr.; Milton M. Cooke, Jr., both of 7311 Ardmore, Houston, Tex. 77021

[22] Filed: Feb. 10, 1975

[21] Appl. No.: 548,279

Related U.S. Application Data

[63] Continuation-in-part of Ser. No. 378,573, July 12, 1973, abandoned.

[52] U.S. Cl. ..... 339/35; 166/65 R; 339/91 R; 339/96

[51] Int. Cl.[2] ..... H01R 13/54

[58] Field of Search ..... 339/20, 21, 34, 35, 339/45, 60, 74, 91, 96, 147; 166/65, 66

[56] References Cited

UNITED STATES PATENTS

| | | | |
|---|---|---|---|
| 2,297,020 | 9/1942 | Page | 166/65 R |
| 2,339,274 | 1/1944 | Kothny | 166/65 R |
| 2,620,029 | 12/1952 | Turechek et al. | 166/65 R |
| 2,770,308 | 11/1956 | Savrenman | 166/65 M |
| 2,944,241 | 7/1960 | Londell | 339/91 P |
| 3,378,811 | 4/1968 | Cullen et al. | 339/96 |
| 3,569,899 | 3/1971 | Laser | 339/21 R |
| 3,694,793 | 9/1972 | Concelman | 339/91 P |

*Primary Examiner*—Joseph H. McGlynn
*Attorney, Agent, or Firm*—Pravel & Wilson

[57] ABSTRACT

Apparatus and method for making an electrical connection downhole in a well pipe including a movable body which can be lowered on a wireline or cable for making a connection to a piston assembly positioned in the well pipe for making an electrical connection downhole to complete an electrical circuit upon pulling upwardly on the wireline or cable.

20 Claims, 6 Drawing Figures

W
11a
10m
10
A
31
12
28c
29
10b
10f
30
28
28d
16
21c
23
10e
20b
21
15
P
20g
20d
21g
14d
20e
20
14
14a
14c
20a
25
19
14a
BHP GAUGE
17
14b
18a
E
18
18b

W
11b
10a
31
27
27a
29a
10d
21c
23
28b
10c
28a
21b
21f
20b
10e
10i
10h
21b
20
19b
24a
20e
21e
20a
25
20f
24b
24
20c
BHP GAUGE
17
E

ELECTRICAL CONNECTOR AND METHOD

CROSS-REFERENCE TO RELATED APPLICATION

This application is a continuation-in-part of U.S. patent application, Ser. No. 378,573, filed July 12, 1973, now abandoned.

BACKGROUND OF THE INVENTION

The field of this invention is electrical connectors and methods for making electrical connection in tubular members such as well pipe.

In oil well drilling and production operations, it is sometimes desirable to operate electronic equipment downhole in the well pipe. Perforators, loggers and pressure gauges are examples of electronic equipment that can be positioned downhole in the well pipe and may require electric power from the surface of the well for operation downhole.

There are several patents that have been directed to making electrical contact in well pipe or the like. For example, U.S. Pat. No. 3,485,299 is directed to a device for making an electrical connection downhole in response to a manipulation of the fluid pressure in the well bore. U.S. Pat. No. 3,331,321 discloses a device which can be mounted in a well pipe for releasing batteries by means of a latch arrangement in order to detonate an explosive charge. And, U.S.S.R. Pat. No. 259,770 discloses a device for making electrical connection in a bore hole wherein the device includes a piston having an electrical contact thereon, the piston and contact being driven into electrical connection with another electric contact by means of an explosion.

SUMMARY OF THE INVENTION

It is an object of this invention to provide a new and improved apparatus and method for making an electrical connection within a tubular member such as an oil well pipe or the like in order to provide electrical power to a point within the well pipe from a remotely located electric power source such as a power source at the surface of the well. The electrical connector of the preferred embodiment of this invention includes a piston assembly disposed within a tubular member such as the well pipe, which is adapted to be connected to a movable body which can be lowered downhole in the pipe or a wireline or the like. Upon manipulation of the wireline or cable, an electrical connection may then be made to a power source located at the surface of the well, whereby various electrically actuated downhole devices may be energized or activated.

DESCRIPTION OF THE PREFERRED EMBODIMENT

Figure 1:
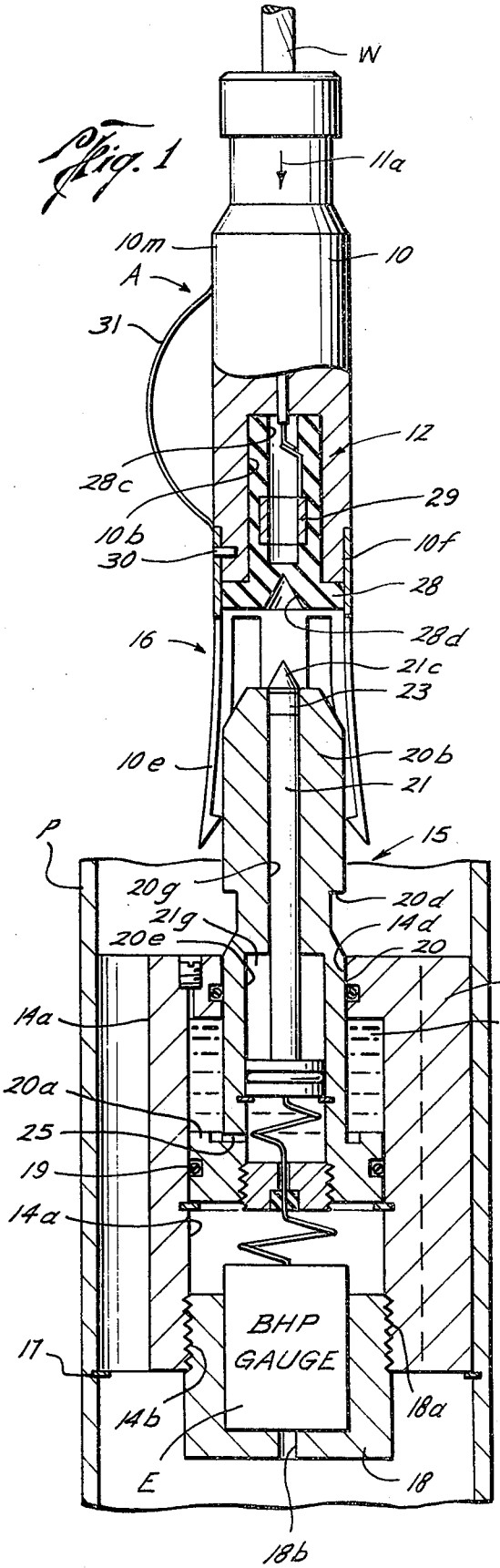
FIG. 1 is a vertical sectional view, partly in elevation, of the electrical connection apparatus of the preferred embodiment of this invention illustrating the apparatus prior to connecting the components thereof downhole in a well.

Referring to the drawings, an apparatus generally designated by the letter A is provided for making a downhole electrical connection between a surface located power source such as a generator or batteries (not shown) and an electrical device E that is positioned downhole in a well pipe P. The electrical connector A basically includes a movable body 10 which is suspended from a cable or wireline W so that the movable body can be moved downhole in the direction of arrow 11a. The movable body 10 has mounted therein an electrical contract means generally designated as 12 which is electrically connected to the power source located at the surface of the well. The apparatus A further includes a body 14 that is permanently or releasably secured or attached to the well pipe P at a point usually downhole and remote from the surface of the well. The body 14 is thus stationary relative to the pipe P, but it may of course be lowered initially into the well with the pipe P, or it may be otherwise movable with the pipe P. The electronic device E usually mounted with the body 14 may be a perforator, a logger, or any other electronic device which can be electrically actuated to perform an operation downhole in a well. In the embodiment of the invention illustrated in the drawings, the letters "BHP" designate a bottom hole pressure gauge for reading pressures downhole in the well. A piston assembly generally designated as 15 is mounted with the body 14 for movement to an actuated position wherein the piston assembly is electrically connected with the electrical contact means 12 positioned within the movable body 10 in order to actuate the piston to cause the piston assembly to make electrical contact.

The body 14 is generally cylindrical in shape and has a diameter substantially equal to the inner diameter of the well pipe P. The body 14 may be mounted within the well pipe P by any suitable means. For example, a mounting ring 17 may be provided to support the body 14 at a fixed position in the well pipe P. The body 14 includes circumferentially positioned passages **14*a* which extend longitudinally of the body 14 in order to provide fluid communication through the stationary body 14** for the passage of drilling mud or other well fluid.

The body 14 includes a central bore **14*a*. The central bore 14*a* includes a threaded bottom portion 14*b* which is adapted to threadedly connect with a correspondingly threaded portion 18*a* on mounting plug 18. The mounting plug 18 is utilized to mount the electronic device E, the bottom hole pressure gauge, with the stationary body 14. The mounting plug 18 includes an opening 18*b*** that exposes the bottom hole pressure gauge to the pressure at the bottom of the well.

The piston assembly 15 includes a main piston member 20 mounted within the housing bore **14*a*. The main piston member 20 includes a piston portion 20*a* that is integrally formed with an elongated portion 20*b***, which shall be referred to as a main shaft portion.

The main piston portion **20*a* is mounted within the housing bore 14*c* for slidable, sealed movement with respect to the bore 14*c*. An annular seal ring 19 extends about the circumference of the piston portion 20*a* in order to mount the piston portion for slidable, sealed movement with respect to the bore. The sealed mounting of the piston portion 20***a* of the main piston member 20 provides a main sealed chamber 14*c*. A retainer ring 20*c* supports the entire main piston member 20 in the initial position illustrated in FIG. 1.

The main shaft portion 20*b* of the main piston member 20 extends outwardly through body top opening 14*d*. The main shaft portion 20*b* is mounted by seal ring 19*b* for slidable, sealed movement with respect to the top body opening 14*d* in order to further seal off the body section chamber 14*c*.

The main shaft portion 20*b* is generally cylindrical in shape and includes a downwardly facing annular shoulder 20*d* which provides a gripping surface for movement of the entire main piston member 20.

The main piston member 20 has a cylindrical bore 20*e* therein that is closed at the bottom by means of a threadedly mounted plug 20*f*. The main piston shaft portion 20*b* further includes a smaller, upper bore 20*g* which extends into the piston bore 20*e*.

The piston assembly 15 further includes an inner or secondary piston member 21 formed of a piston portion 21*a* and a spear shaft portion 21*b*. The piston portion 21*a* is mounted for slidable, sealed engagement with respect to the piston bore 20*e* by means of annular seal 21*b*. The spear shaft portion 21*b* is integrally formed with the piston portion 21*a* and extends through the upper main piston shaft bore 20*g*. The spear shaft 21*b* includes a pointed nose 21*c*. A seating ring 21*e* is mounted onto the wall of the main piston shaft bore 20*e* in order to support the inner piston 21 in the initial or normal position of FIG. 1. An annular electrical contact 23 is mounted in an annular recess in the spear shaft 21*b* adjacent the nose 21*c* thereof. The annular electrical contact 23 is electrically connected to a conductor 24 which extends downwardly through a small passageway 21*f* in the spear shaft portion 21*b* and through the plug 20*f* into electrical connection with the bottom hole pressure gauge E. A seal ring 24*a* is mounted in the bottom of the spear shaft portion 21*a* in order to seal against the passage of fluid upwardly through the small spear shaft passage 21*f*. Another annular seal or resilient plug 24*b* is mounted in the plug 20*f* and has the conductor 24 extending therethrough.

The slidable, sealable mounting of the inner piston portion 21*a* cooperates with the sealed mounting of the plug 20*f* by seal 24*b* to provide an inner sealed chamber 21*g*. Radial passageways 25 are located in the main piston portion 20*b* and extend between the inner sealed piston chamber 21*g* and the main sealed housing chamber 14*c* to provide fluid communication therebetween.

A constant volume of fluid 26, which may be any suitable hydraulic or other fluid, is located in the main sealed body chamber 14*c* and also in the inner sealed chamber 21*g* for moving the inner piston 21 in response to movement of the main piston 20. Whenever the main piston 20 is moved upwardly off of its initial position on the ring 20*c*, fluid in the main sealed chamber 14*c* is displaced through the radial passageways 25 in the piston portion 20 into the inner sealed chamber 21*g* thereby causing the inner piston 21 to move upwardly in the direction of arrow 11*b* and outwardly of the main piston portion 20*a*.

The movable body 10 includes a main body portion 10*a* which is connected to and suspended from the cable or wireline W having a single conductor cable 27 mounted therewith. The single conductor cable may be mounted in the center of the wireline W and is electrically connected to the surface electrical power source (not shown). The main movable body portion 10*a* includes a cylindrical recess 10*b* which is open at the bottom 10*c* of the body 10*a*. A resilient protective cover 28 is mounted on the bottom 10*c* and extends into the cylindrical recess 10*b* in order to provide a sealed connection chamber 10*d*.

The resilient protective cover 28 may be made of any suitably resilient material and includes a cover portion 28*a* integrally formed with a cylindrical, hollow portion 28*b*which is generally cylindrical in shape and extends into and conforms to the walls of the cylindrical recess 10. An annular electrical contact 29 is mounted on the inside wall 28*c* of the cylindrical portion 28*b* of the resilient protective cover 28. An electrode 29*a* extends upwardly from electrical connection with the annular contact 29*a*. The electrode 29*a* is electrically connected by suitable means to exposed wire 27*a* of the conductor 24. A central notch portion 28*d* is formed at the bottom center of the protective cover portion 28*a* in order to receive the pointed nose 21*c* of the spear shaft 21*b*. The protective cover 28 cooperates with the cylindrical body recess 10*b* to form the dry, sealed connecting chamber 10*d*, which is sealed against the entry of well fluid or other fluid whereby a dry, electrical connection can be made between the annular contact 29 of the moving body 10 and the annular spear shaft contact 23 on the stationary body 14.

Figure 2:
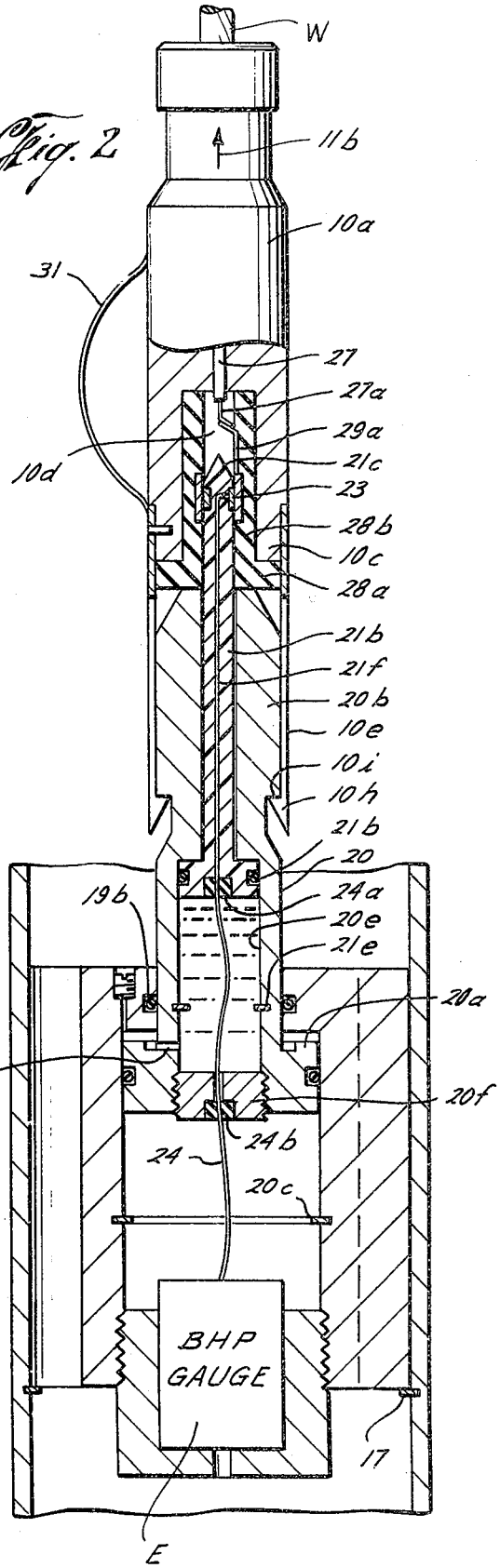
FIG. 2 is a view similar to FIG. 1 wherein the electrical connection of the apparatus has been completed.

The actuator means 16 includes a plurality of flexible gripping fingers 10*e* mounted in recesses 10*f* at the bottom side portions of the movable body 10 on shear pins 30. The gripping fingers include hook portions 10*h* at the bottom thereof which, when pushed outwardly by main shaft portion 20*b* as shown in FIG. 1, are urged resiliently inwardly such that the hook portions will move under the annular gripping shoulder 20*e* on the main shaft portion 20*b* whenever the movable body 10 is positioned in abutment with the main shaft portion 20*b* as illustrated in FIG. 2. The hooked portions 10*h* have inwardly extending, upwardly facing shoulders 10*i* that engage the downwardly facing annular shoulder 20*d* on the main shaft portion 20*b* in order to lock the entire main piston member 20 for movement with the movable body 10.

The use of shear pins 30 to mount the gripping fingers 10*e* provides a release means for releasing the gripping fingers 10*e* from the remainder of the movable body portion 10*a*. This is accomplished by exerting sufficient upward force in the direction of arrow 11*b* on the wireline W to cause the releasable pins 30 to shear thereby freeing the entire movable body pin 10*a* for movement upwardly and out of the well pipe P.

OPERATION AND USE

In the operation and use of the apparatus A for making electrical connection downhole in an oil well or the like, the body 14 is positioned by any suitable means such as the mounting ring 17 in a permanently or releasably secured position within the well pipe P. The electronic device E, which in the embodiment illustrated in the invention, is a bottom hole pressure gauge, is mounted with the body 14 by means of the threaded plug 18. The electrical conductor 24 connects the bottom hole pressure gauge E with the annular electrical contact 23 mounted on the spear shaft 21b.

The movable body 10 is then lowered into the well pipe P on the wireline W. The annular contact ring 29 mounted in the sealed, dry body chamber 10*d* is electrically connected through conductor 27 with an electrical power source located at the surface of the well. The movable body 10 may have a plurality of centralizers 31 extending radially outwardly from the outside cylindrical body wall 10*m* in order to center the movable body 10 substantially in the center of the well pipe P. The movable body 10 mounted on the wireline W is moved downhole to a position adjacent the stationary body 14 and the piston assembly generally designated as 15 (FIG. 1). Then, the movable body 10 is lowered further downwardly until the bottom of the protective cover portion 28 engages the top of the main shaft portion 20*b*. In this position, the hooked bottom ends 10*h* of the resilient gripping fingers 10*e* hook under the downwardly facing annular shoulder 20*d* on the main shaft portion 20*b*. The gripping fingers 10*e* thus serve to lock the main shaft portion 20*b* and the piston portion 20*a* of the main piston member 20 for movement upwardly with the movable body 10.

The spear shaft 21*b* is actuated by moving the movable body 10 and the main piston member 20 therewith upwardly in the direction of arrow 11*b*. Movement of the main piston portion 20*a* of the main piston member 20 upwardly causes the fluid 26 in the body chamber 14*c* to be displaced and transferred through radial passageways 25 into the inner piston chamber 21*g*, which causes the entire inner piston 21, including the inner piston portion 21*a* and the spear shaft portion 21*b*, to be displaced upwardly with sufficient force to cause the spear shaft portion 21*b* to puncture and penetrate the protective covering 28 on the movable body 10.

The movable body 10 on the wireline W is moved upwardly a sufficient distance to cause movement of the spear shaft portion 21*b* to an extended position wherein the spear shaft electric contact 23 is positioned concentrically within the electrical contact 29 mounted with the movable body 10. Thus, the nose of the spear shaft 21*b* punctures the protective covering 28 through the notched portion 28*d* and continues movement upwardly into the movable body chamber 10d until the contact rings 23 and 29 are concentrically disposed adjacent to each other and in electrical contact. The resilient material of the protective covering 28 serves to resiliently, sealably engage the portion of the spear shaft 21*b* positioned within the covering in order to maintain the dry chamber 10*d* in a dry condition such that the electrical connection between the rings 23 and 29 is substantially dry. Once the spear shaft 21*d* is moved to the extended position illustrated in FIG. 2 wherein electrical contact is made between the contact rings 23 and 29, the electrical circuit is completed from the power source at the surface downhole to the bottom hole pressure gauge E.

At such time as desired after the actuation of the gauge E has taken place, the wireline W is pulled upwardly with sufficient force to cause the releasable pins 30 to shear, thereby releasing movable body 10 from the gripping fingers 10*e* for movement of the body 10 upwardly in the well pipe to the surface.

Although the tubular member has been disclosed in the preferred embodiment as a well pipe, it should be understood that the term "tubular member" includes any pipe or tube in which it is desired to make electrical connection. Further, it is within the scope of the invention to move the movable body 10 by any available means in any direction to the position in a tubular member adjacent the stationary body positioned therein.

As illustrated hereinafter in FIGS. 3–6, the chamber 10*d* (FIG. 2) may be connected by a port to the area externally of the body 10, and a grease or lubricant can fill such chamber 10*d*. When the covering 28 is punctured by the spear 21, the grease or lubricant is forced out of the port, as explained hereinafter for FIG. 3 and 4, but the grease or lubricant inhibits well fluid from interfering with the electrical contact between contacts 23 and 29.

Figure 3:
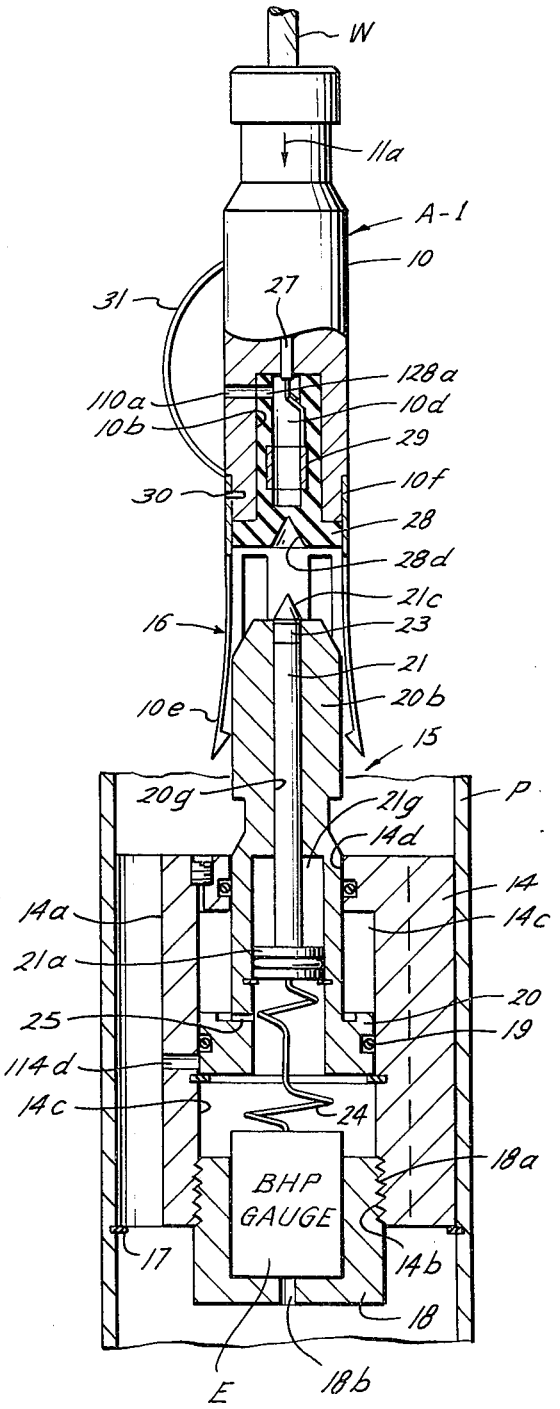
FIG. 3 is a vertical sectional view illustrating one position of a modification of the apparatus of FIGS. 1 and 2.
Figure 4:
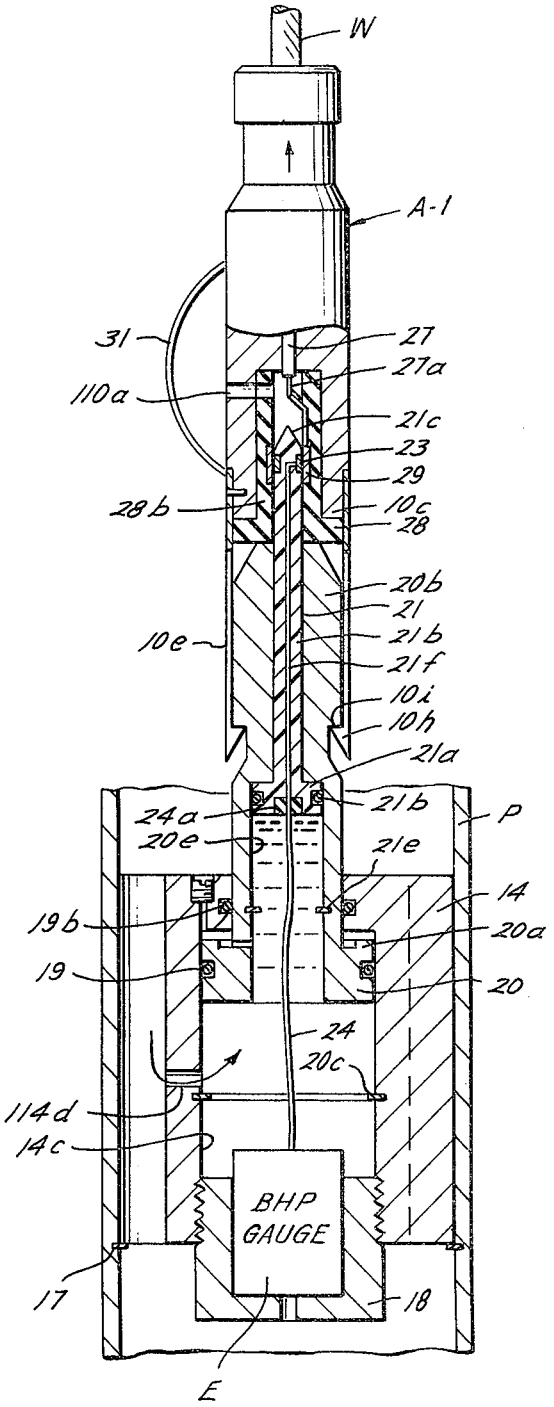
FIG. 4 is a vertical sectional view illustrating an activated position of the apparatus of FIG. 3.

FIGS. 3 and 4 illustrate a modification of the downhole electrical connection apparatus of FIGS. 1 and 2. The apparatus of FIGS. 3 and 4 is designated generally A-1, and the ports which are identical in the apparatus A-1 and the apparatus A bear like numerals and/or letters.

As can be seen by a comparison of the apparatus of FIGS. 1 and 3, the body 10 has been modified by providing a port 110*a* therethrough which communicates with a port 128*a* in the resilient protective cover 28. Such ports 110*a* and 128*a* establish communication from externally of the body 10 to the chamber 10*d*. The chamber 10*d* is preferably filled with a grease or other lubricant so as to inhibit or prevent well fluid from entering the chamber 10*d*, but upon the spear 21 puncturing the cover 28 and entering the chamber 10*d*, the grease or lubricant is forced out of the chamber 10*d* through the ports 110*a* and 128*a*, to the extent the spear 21 displaces such grease or lubricant. As previously mentioned, a similar arrangement including the ports 110*a* and 128*a* may be incorporated in the form of the invention A illustrated in FIGS. 1 and 2.

The modified apparatus A-1 further differs from the embodiment of the apparatus A by the omission of the plug 20*f*, and the inclusion of a connecting communicating passage 114*d*, the purpose of which will be hereinafter explained. Under normal operating conditions, the passage or opening 114*d* is closed by the piston 20, so that fluid pressure within the well pipe P, and externally of the member 14 cannot enter the chamber or bore 14*c*. However, upon pulling the piston 20 upwardly by pulling upwardly on the wireline or cable W, the piston 20 moves upwardly above the port 114*d*, thereby establishing fluid communication between the chamber 14*c* and the area externally of the housing or member 14 so that the well fluid pressure within the pipe or casing C can then act upwardly on the piston portion 21*a* of the secondary piston member 21, and also on the lower surface of the piston 20 to cause them to travel upwardly relative to the housing 14 as illustrated in FIG. 4, so as to force the pointed nose 21*c* of the spear 21 through the protective cover 28 to bring the electrical contacts 23 and 29 into electrical engagement for completing the electrical circuit in the same manner as heretofore described in connection with FIGS. 1 and 2.

The operation and use of the modified apparatus A-1 is particularly suitable for use in wells having medium or moderate well fluid pressures in the pipe of casing P in the vicinity of the housing or body 14. Although the invention is not to be limited to any particular well pressures, by way of example, the modified apparatus A-1 would be particularly suitable for operation where the well pressures ranged from 2,500 psi to 3,500 psi. For lower well pressures, or in wells which are essentially dry, the apparatus A of FIGS. 1 and 2 would be particularly suitable.

Figure 5:
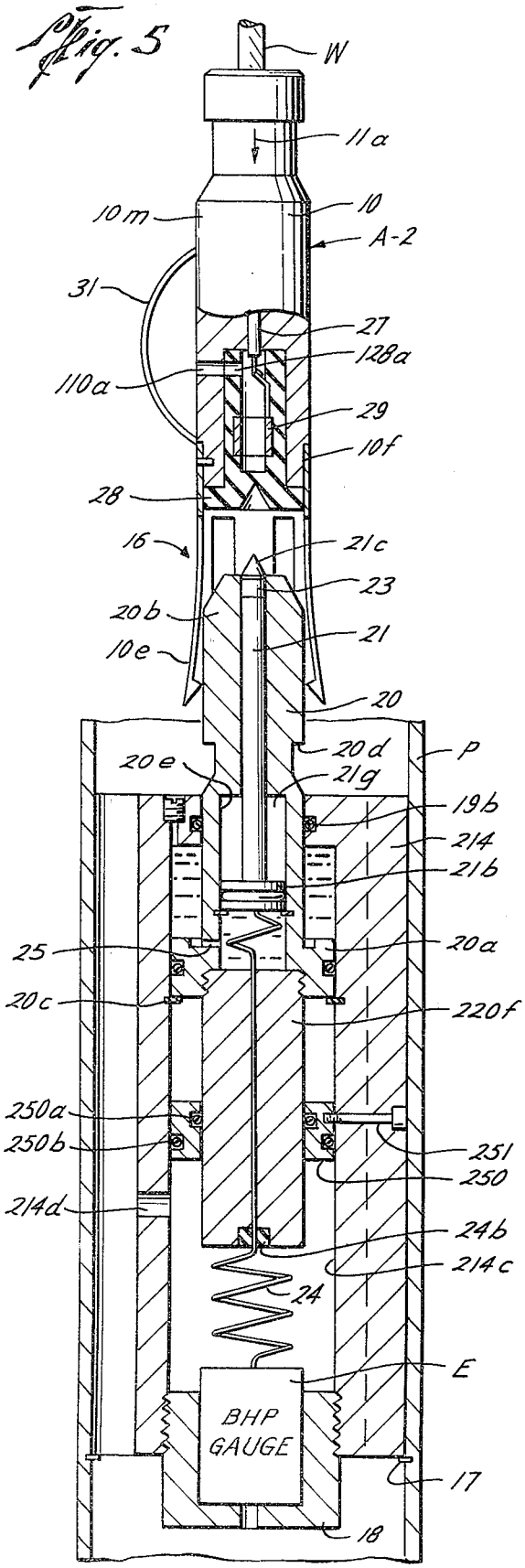
FIG. 5 is a vertical sectional view of a second modification of the apparatus of FIGS. 1 and 2.
Figure 6:
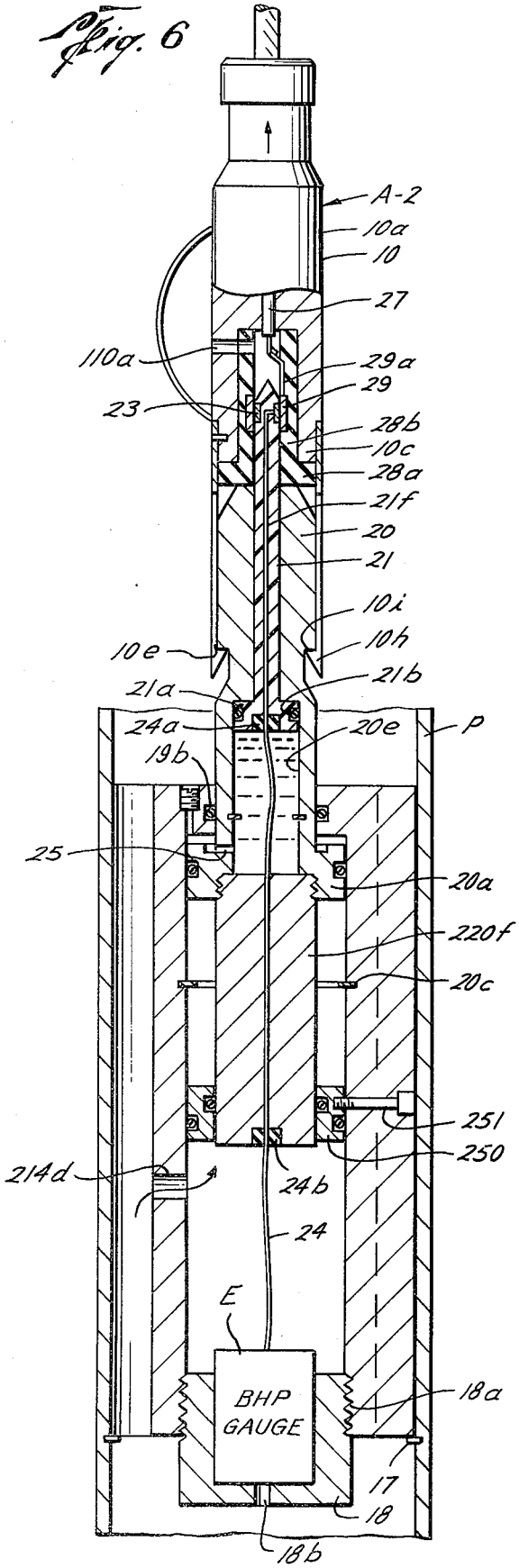
FIG. 6 is a vertical sectional view of the apparatus of FIG. 5 in an activated position.

Reference is now made to another modified form of the apparatus designated A-2 in FIGS. 5 and 6. The parts of the apparatus A-2 which are identical to, or substantially the same as, the parts in FIGS. 1–4 have the same letters and/or numerals designating same.

The apparatus A-2 is particularly suitable for use in wells wherein the well pressure from the fluid in the pipe or casing P is extremely high, for example and not by way of limitation, above about 3,500 psi. By comparison of the apparatus A-2 with the apparatus A and A-1, certain modifications in the apparatus A-2 will be apparent, and are hereinafter described. Thus, the plug 20*f* of the apparatus A of FIGS. 1 and 2 has been modified in the apparatus A-2 and appears as an elongated plug 220*f* and is slidable in aa seal ring 250. The seal ring 250 is mounted in chamber 214*c* so that it cannot move relative to the modified housing 214, preferably by means of a removable bolt 251 which extends through the housing 214 and is threaded or is otherwise connected to the seal ring 250. An internal seal member 250*a* and an external seal member 250*b* are mounted on the seal ring 250 in the preferred embodiment and they preferably are resilient O-rings formed of rubber or other suitable sealing material. A port or passage 214*d* is provided in the wall of the housing 214 for establishing fluid communication between the area externally of the housing 214 and the well casing or pipe P and the chamber or bore 214*c* below the seal ring 250. Since such port 214*d* is always open and is always therefore establishing communication between the area externally of the housing 214 and the chamber 214*c*, the fluid pressure in the well is acting both upwardly and downwardly on the movable parts of the piston 20 and the spear 21 which are exposed to such pressure. In the preferred embodiment, the cross-sectional area of the movable plug 220*f* is equal to, or substantially equal to, the cross-sectional area of the upper portion of the piston 20 above the seal 19*b* so that the well fluid pressure acting above and below the movable parts is equalized, or substantially equalized. The piston 20 is pulled upwardly by the cable.

In the operation or use of the apparatus A-2 in carrying out the method of this invention, the same basic operation and the steps set forth in connection with the apparatus A are performed. Thus, the movable body 10 is lowered into the well pipe on the wireline or cable W so that the resilient gripping fingers 10*e* hook under the downwardly facing annular shoulder 20*d*. Upward pulling is then exerted on the wireline or cable W to pull the piston 20 upwardly to cause the fluid 26 in the body chamber 14*c* above the piston 20 to be displaced and transferred through the passageways 25 into the inner piston chamber 21*g*, which causes the inner piston 21 to move upwardly and ultimately to penetrate the protective covering 28 and cause the contacts 23 and 29 to engage with each other to complete the electrical circuit in the system. If grease or lubricant is in the chamber 10*d*, it is forced outwardly through the ports 128*a* and 110*a*, as explained in connection with the apparatus A-1.

From the foregoing, it can be seen that the method of this invention may utilize different forms of apparatus, and basically, the method includes the steps of disposing a first body having an electrical contact downhole in a well pipe and also disposing a second body having an electrical contact downhole in the well pipe, with the electrical contacts being spaced apart from each other. Thereafter, by pulling upwardly on one of the bodies, fluid pressure is utilized to move the electrical contacts into electrical engagement with each other for thereby providing an electrical connection downhole in the well pipe. In the form of the invention shown in FIGS. 1 and 2, and 5 and 6, the fluid pressure which causes the electrical contacts to move into engagement with each other is separate from the well fluid pressure and is displaced by the upward movement of the piston portion 20*a* to thereby move the smaller piston 21*b* upwardly. In the form of the invention shown in FIGS. 3 and 4, the well fluid pressure is relied upon solely for causing the upward movement of the piston 21 for making the electrical engagement between the contacts 23 and 29. The invention is thus directed broadly to the concept of making an electrical contact downhole in a well or similar location by pulling upwardly on a wireline or cable to bring the electrical contacts into engagement with each other.

The foregoing disclosure and description of the invention are illustrative and explanatory thereof, and various changes in the size, shape, materials, components, circuit elements, wiring connections and contacts as well as in the details of the illustrated circuitry and construction may be made without departing from the spirit of the invention.

We claim:

1. Apparatus for making an electrical connection in a tubular member, comprising:

a first body disposed in said tubular member;

a second body mounted on a flexible line for movement in said tubular member to establish a connection with said first body, said second body having an electrical contact therewith;

electrical contact means mounted with said first body for engaging said electrical contact on said second body, said electrical contact means including a piston assembly mounted with said first body for movement with respect thereto and having a first body electric contact mounted therewith; and actuator means operable by manipulating said flexible line for actuating said piston assembly to move said flexible line for actuating said piston assembly to move said first electrical contact into engagement with said electrical contact on said second body to provide an electrical connection.

2. The structure set forth in claim 1, including:

an electric power source located at the surface of an oil well;

said tubular member being well pipe extending downhole in an oil well;

said second body being suspended from said flexible line for movement down said well pipe to a position adjacent said first body;

said electric contact on said second body being electrically connected to said electric power source;

a downhole electric device; and said first body electric contact being electrically connected to said downhole electric device.

3. The structure set forth in claim 1, including:

sealing means mounted with said second body for sealing off said electrical connection between said second electrical contact and said first electrical contact.

4. The structure set forth in claim 1, wherein:

said first body electric contact having an annular configuration; and said electric contact for said second body having an annular configuration.

5. The structure set forth in claim 1, including:

said second body having a chamber therein and means for sealing said second body chamber against fluid entry; and said electric contact for said second body being positioned in said chamber.

6. The structure set forth in claim 1, wherein said piston assembly means includes:

a first shaft member mounted with said first body for movement with respect thereto;

said first body electric contact being mounted for movement with said first shaft member; and said first shaft member being movable to an extended position in which said first body electric contact electrically engages said electric contact for said second body.

7. The structure set forth in claim 6, including:

said first shaft member being mounted in a first, sealed chamber in said first body; and means for introducing fluid under pressure into said first, sealed chamber for moving said first shaft member to said extended position.

8. The structure set forth in claim 1, wherein said piston assembly includes:

a first piston member having said first body electrical contact mounted therewith;

a second piston member mounted in said first body for movement with respect thereto; and means mounting said first piston member for movement with respect to said second piston member.

9. The structure set forth in claim 8, wherein said actuator means includes:

connector means mounted on said second body for connecting said second piston for movement with said second body; and fluid means for moving said first piston and first shaft to said extended position in response to movement of said second piston member with said second body.

10. The structure set forth in claim 9, wherein said actuator means includes:

grip means attached to said second body for gripping said second piston member for movement with said second body.

11. The structure set forth in claim 10, including:

fluid means for moving said first piston member to an extended position in response to movement of said second piston member with said second body for making electrical contact between said first body electrical contact and said electrical contact for said second body.

12. The structure set forth in claim 10, wherein said grip means includes:

a flexible finger extending from said movable body for engaging said second piston member.

13. The structure set forth in claim 10, including:

release means for releasing said grip means from attachment to said second body.

14. The structure set forth in claim 8, including:

said second piston member having an inner, sealed chamber therein, said first piston member being mounted for slidable, sealable movement within said inner chamber; and said first body having an outer sealed chamber with said second piston member being mounted for slidable, sealed movement therein.

15. The structure set forth in claim 14, including:

said inner and outer chambers being in fluid communication with each other and having fluid therein; and said actuator means and electrical contact means including means for transferring fluid from said outer chamber to said inner chamber in response to movement of said second piston member whereby said first piston member moves with respect to said second piston member.

16. Apparatus for making a remote electrical connection, comprising:

a first body having attached therewith a first electric contact means which is electrically attached to an electrically driven device;

a second movable body having attached therewith a second electrical contact means which is electrically connected to an electric power source, said second body being movable to a remote position adjacent to said first body;

said first electrical contact means including a spear member having an electrical contact mounted thereon;

actuator means mounting said spear member for movement outwardly of said first body and into said second body for engaging said second electrical contact means in response to a pulling force being exerted on said actuator means; and said second movable body including a gripper means for gripping said actuator means whereby pulling force exerted on said actuator means causes said spear member to move outwardly of said first body and into said second body for making electrical contact.

17. Apparatus for making an electrical connection in a well pipe, comprising:

a first body disposed in said well pipe;

a second body mounted on a flexible line for movement in said well pipe to establish a downhole electrical connection with said first body, said second body having an electric contact mounted therewith;

electrical contact means mounted with said first body in spaced relationship to said electrical contact on said second body and adapted to be moved longitudinally for making electrical contact with said electrical contact on said second body; and actuator means operable by pulling upwardly on said flexible line for causing fluid pressure to move said electrical contact means into engagement with said electrical contact on said second body to provide an electrical connection downhole in the well pipe between said electrical contact and said electrical contact means.

18. A method for making an electrical connection in a well pipe, comprising:

disposing a first body having an electrical contact downhole in a well pipe;

disposing a second body having an electrical contact downhole in the well pipe in proximity to said first body, with the electrical contacts spaced from each other; and pulling upwardly on said second body for causing fluid pressure to move said electrical contacts into electrical engagement with each other for thereby providing an electrical connection downhole in the well pipe.

19. The method set forth in claim 18, wherein:

the fluid pressure is well pressure in the well pipe.

20. The method set forth in claim 18, wherein:

the fluid pressure is at least in part from fluid separate from the well fluid.

* * * * *